US008337152B2

(12) United States Patent
Lehtonen et al.

(10) Patent No.: US 8,337,152 B2
(45) Date of Patent: Dec. 25, 2012

(54) CENTRIFUGAL PUMP, A SHAFT SLEEVE AND A STATIONARY SEAL MEMBER

(75) Inventors: Jorma Tapani Lehtonen, Mänttä (FI); Heikki Manninen, Vilppula (FI)

(73) Assignee: Sulzer Pumpen AG, Winterthur (CH)

( * ) Notice: Subject to any disclaimer, the term of this patent is extended or adjusted under 35 U.S.C. 154(b) by 984 days.

(21) Appl. No.: 12/264,662

(22) Filed: Nov. 4, 2008

(65) Prior Publication Data

US 2009/0116960 A1 May 7, 2009

(30) Foreign Application Priority Data

Nov. 5, 2007 (EP) ..... 07120013

(51) Int. Cl.
*F03B 11/00* (2006.01)
*F01D 25/16* (2006.01)

(52) U.S. Cl. ..... 415/174.1; 415/231; 277/413

(58) Field of Classification Search ..... 415/174.1, 415/231, 230, 128; 277/413
See application file for complete search history.

(56) References Cited

U.S. PATENT DOCUMENTS

| | | | | |
|---|---|---|---|---|
| 2,660,487 | A | 5/1951 | Wilfley | |
| 4,418,919 | A | 12/1983 | Wentworth | |
| 5,816,784 | A | 10/1998 | Postuchow et al. | |
| 5,921,748 | A * | 7/1999 | Frater | 415/172.1 |
| 2006/0280599 | A1 * | 12/2006 | Manninen | 415/174.1 |

FOREIGN PATENT DOCUMENTS

| | | | |
|---|---|---|---|
| CN | 1865710 | A | 11/2006 |
| EP | 1 724 470 | A | 11/2006 |
| FR | 2 697 598 | A1 | 5/1994 |
| GB | 896 481 | A | 5/1962 |
| GB | 1 096 816 | A | 12/1967 |

OTHER PUBLICATIONS

Chinese Office Action mailed on Sep. 21, 2011, for Chinese Patent Application No. 200810169178.3, English Translation, 8 pages.
Partial European Search Report mailed on Jan. 5, 2009, for European Patent Application No. 08166145.6, 4 pages.
European Search Report mailed on Mar. 23, 2009, for European Patent Application No. 08166145.6, 3 pages.

* cited by examiner

*Primary Examiner* — Caridad Everhart
(74) *Attorney, Agent, or Firm* — Kilpatrick Townsend & Stockton LLP

(57) ABSTRACT

The present invention relates to a centrifugal pump, a shaft sleeve and a stationary seal member for a static seal used in connection with a dynamic sealing of a centrifugal pump. The invention relates to a static seal the clearance of which may be adjusted while the pump is running. Especially the invention discusses the novel structure of such a static seal. A characterizing feature of a centrifugal pump comprising a pump housing (8), a shaft (6), an impeller attached on the shaft, a dynamic sealing (4) having a sealing chamber (12) and a repeller (14) mounted on the shaft (6), and a static seal (2) arranged in a shaft space (42) behind the dynamic sealing (4) as seen from the direction of the impeller, said static seal (54, 54') comprising an axially adjustable seal cover (56) including a stationary seal member; and a rotary seal member arranged on the shaft (6), is that the seal cover (56) is provided with a flexible seal member (77, 92), whose counter member (68) is arranged in connection with a shaft sleeve (60) arranged on the shaft (6).

15 Claims, 2 Drawing Sheets

--PRIOR ART--

--PRIOR ART--

CENTRIFUGAL PUMP, A SHAFT SLEEVE AND A STATIONARY SEAL MEMBER

Figure 2:
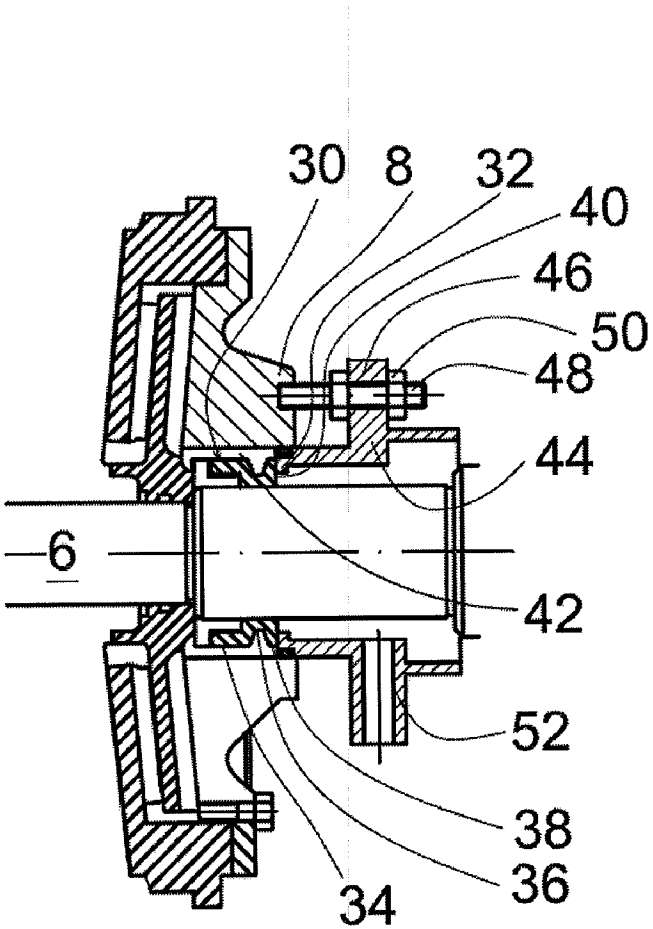

This application claims the priority of European Application No. 07120013.3, filed on Nov. 5, 2007, the disclosure of which is incorporated herein by reference.

The present invention relates to a centrifugal pump, a shaft sleeve and a stationary seal member for a static seal used in connection with a dynamic sealing of a centrifugal pump. The invention relates to a static seal the clearance of which may be adjusted while the pump is running. Especially the invention discusses the novel structure of such a static seal.

A dynamic sealing is a sealing arrangement, which is, without any mechanical contact, able to seal a centrifugal pump during its operation so that no liquid leaks along the shaft towards the pump bearings and the pump drive. Other sealing arrangements for the same purpose are, for example, braided packings and slide ring seals, which both require mechanical contact between the rotary and stationary surfaces. In other words, it is clear that the above-mentioned seal types based on continuous mechanical contact suffer at some point of their life cycle from wearing problems.

A dynamic sealing is located behind the pump volute in front of the pump bearing (seen from the direction of the pump inlet opening) in an annular chamber, called also as the dynamic sealing chamber, arranged in connection with the rear wall of the pump. Said chamber is in direct flow communication with the pump volute, where the pump impeller rotates. A rotary disc attached on the pump shaft divides said chamber to an impeller side cavity and a pump bearing side cavity. The rotary disc is provided with vanes facing the bearing side cavity, whereby it can also be called a repeller, whereas the other side of the disc is even. Considering a case where said annular chamber contains liquid, and the repeller is rotating, the vanes on the repeller disc tend to pump the liquid first radially outwards and then around the outer edge of the disc to the impeller side cavity of the chamber. However, now that the pump is in operation, the pressure generated in the pump volute by the impeller effects to the opposite direction, i.e. the impeller forces liquid towards the bearings. Thereby, an equilibrium can be found where a liquid ring rotated by the above mentioned repeller vanes compensates the pressure generated by the impeller and the pump is sealed in such a away that no liquid enters the shaft space between the annular chamber and the pump bearings.

However, when the pump is not running, the liquid to be pumped has free access round the outer edge of the repeller disc into the shaft space behind the dynamic sealing chamber (as seen from the direction of the pump inlet opening) and therethrough to the atmosphere, unless it is prevented in a suitable manner. This is carried out by a so-called static seal, which has a number of different variations. Among others, patent and utility model documents: CA-C-1,317,329, DE-A1-101 59 638, DE-U1-203 12 422, DE-U1-20 2004 007 505, EP-A1-1 724 470, GB 1174636, and WO-A1-03/040598 relate to static seals. In the following, two basic types of a static seal have been discussed.

Figure 1:
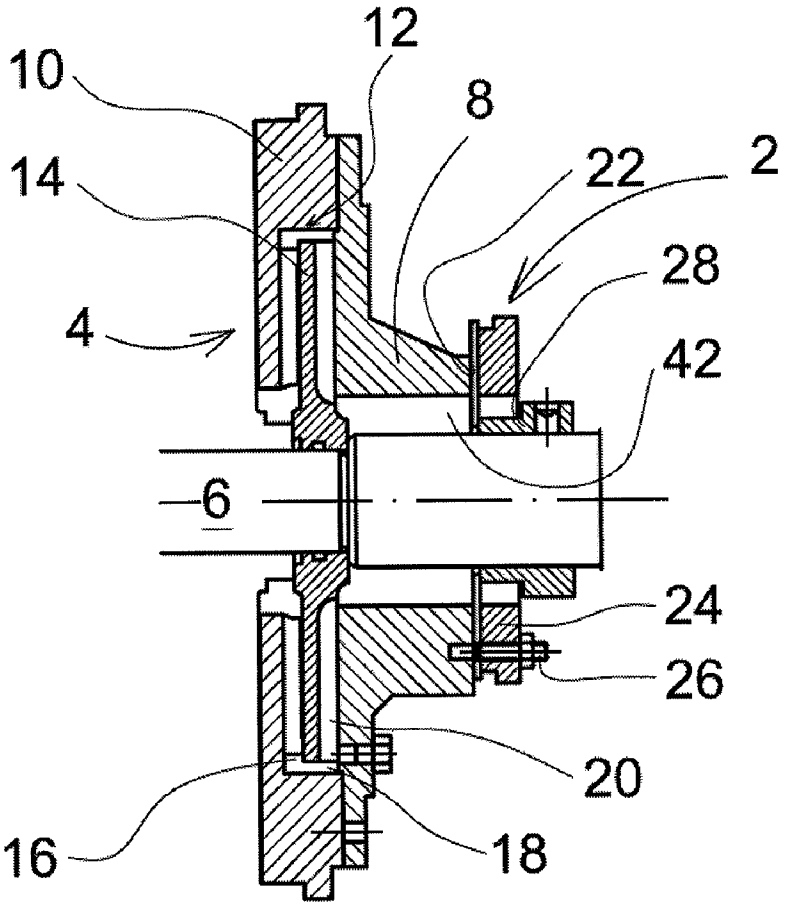

FIG. 1 shows the seal part of a centrifugal pump utilizing a dynamic sealing and a static seal discussed e.g. in DE-U1-203 12 422, and DE-U1-20 2004 007 505. The static seal of FIG. 1 is formed of an annular disc, which is manufactured of a flexible material, for example plastics, and extends from the pump housing radially towards the pump shaft. The flexible annular disc is attached to the pump housing or to the cover thereof, and forms a stationary static seal surface. An annular ring forming the rotary counter surface and facing the flexible disc is attached on the shaft. The annular ring has been mounted on the shaft in such a way that when liquid flows from the direction of the pump volute to the shaft space, the liquid forces the flexible disc against the annular ring, or more precisely against the seal surface thereof. The position of the annular ring may be altered if and when either the flexible disc or the seal surface of the ring has worn to such a degree that the sealing requires re-adjustment. However this is problematic, as, in order to be able to adjust the position of the annular ring, the pump has to be stopped. Another problem can be seen in the mounting of the annular ring on the shaft. Since the annular ring must always have a certain gap in relation to the pump shaft it is clear that the seal surface of the ring, after the ring has been tightened in its position by means of one or more screws, is not exactly perpendicular to the pump axis but slightly inclined. This results in leakage and wearing of the seal surface/s.

EP-A1-1 724 470 offers a solution to the first one of the above discussed problems by introducing a static seal structure, which is adjustable while the pump is running. The static seal is formed of a sleeve-like member arranged on the pump shaft and resting against the hub of the repeller. This sleeve-like member is the rotary part of the static seal. As the counter member of the static seal works a tubular member, so-called seal cover, arranged slidably against the inner cylindrical surface of the pump housing, i.e. the outer surface of the static sealing chamber. The position of the counter member is axially adjustable whenever needed. However, it has been learned that in practical applications it is almost impossible to adjust the seal cover such that its surface facing the rotary seal member is exactly perpendicular to the axis of the pump. The reason for this is the fact that when the seal cover is tightened by means of three or four adjustment screws the cover cannot ever be exactly aligned with the pump axis but there is always a small deviation from the axial direction as there is always a minor gap between the cylindrical seal cover and the cylindrical inner surface of the static sealing chamber housing. Now that the seal surface of the rotary seal member is always exactly perpendicular to the shaft, the natural result of the misalignment of the two surfaces is a leak in the sealing. The static seal of FIG. 2 has yet another disadvantage. When studying in more detail the operation of the pump and the behaviour of the liquid when the pump is stopped, or actually about to be stopped, it has been learned that after the pump is about to stop rotating, the liquid entering the shaft space is still rotating due to its rotation in the repeller chamber, in other words in the dynamic sealing chamber, whereby the liquid flows as a thin layer in the shaft space i.e. in the static seal chamber spirally along the outer wall thereof towards the static seal. When the rotating liquid layer meets the static seal i.e. the seal cover, the liquid flow has to turn into radial direction towards the axis so that the liquid flows along the radial surface of the seal cover. Now that the radial surface of the seal cover forms one of the seal surfaces of the static seal, and when there is no liquid pressure against the rotary seal part, yet, there is a small gap between the seal surfaces, through which some liquid is able to escape before the liquid fills the entire shaft space, and presses the rotary seal part against the stationary counter surface.

There are also prior art static seals that suffer yet another problem. When the centrifugal pump is used for pumping liquid containing solids, or liquid carrying crystallizing material, either the solids or some liquid has entered the gap between the seal surfaces just prior to closing of the gap. When the pump is re-started the gap opens, but due to the structure of the sealing, the solids, or the crystals formed in the gap, are either not able to escape from the gap, or escape in the direction of the shaft space between the static seal and the volute due to centrifugal force acting on them. In the first option the material wears directly the seal surfaces, and in the second option the material remains waiting for the next sealing operation i.e. liquid forcing the solids or crystals in the gap again.

An object of the present invention is to introduce a static seal structure that is able to eliminate at least some of the problems and disadvantages of the prior art centrifugal pumps.

In accordance with a preferred embodiment of the invention a characterizing feature of the centrifugal pump comprising a pump housing, a shaft, an impeller attached on the shaft, a dynamic sealing having a sealing chamber and a repeller mounted on the shaft, and a static seal arranged in a shaft space behind the dynamic sealing as seen from the direction of the impeller, said static seal comprising an axially adjustable seal cover including a stationary seal member; and a rotary seal member arranged on the shaft, is that the seal cover is provided with a flexible seal member, whose counter member is arranged in connection with a shaft sleeve arranged on the shaft.

In accordance with another preferred embodiment of the invention a characterizing feature of the shaft sleeve to be used in connection with a static seal of a centrifugal pump, is that said shaft sleeve is provided with a radially outwardly extending collar at its one end, the collar having at least one substantially radial surface acting as a static seal surface.

In accordance with a third preferred embodiment of the invention a characterizing feature of the stationary seal member for a static seal to be used in connection with a dynamic sealing of a centrifugal pump, is that said stationary seal member comprises a tubular body part, and a seal lip extending radially inwardly from the body part.

In accordance with yet another preferred embodiment of the invention the sealing members i.e. the seal surfaces have been arranged such that the stationary seal surface is positioned such that it is closer to the pump volute than the rotary seal surface.

Other characteristic features of a centrifugal pump, a shaft sleeve and a stationary seal member in accordance with the present invention will become clear in the accompanying claims.

By means of the static seal of the invention, at least following advantages are achieved:

When the pump impeller and the repeller rotate, the repeller rotates the liquid ring in the dynamic sealing chamber. After the power input to the pump has been switched off, the pump is still rotating but at a decelerating pace. Now that the repeller is not able to create sufficient back pressure the pressure prevailing in the volute pushes the rotating liquid ring towards the static sealing space between the dynamic sealing and the bearings of the pump shaft so that the liquid ring finally enters the shaft space where the static seal is arranged. The shaft space or static sealing space has a cylindrical outer surface along which the liquid entering from the dynamic sealing advances as a liquid layer towards the static seal. Now that the static seal is formed of a flexible lip such that the outer circumference of the lip is tightly against its mounting surface, and the gap between the lip and its counter surface is at the radially inner circumference of the lip, the liquid layer pressure pushes the flexible stationary seal surface against the rotary surface ensuring a reliable sealing in the shaft space so that the liquid is not able to enter the gap between the seal surfaces. Simultaneously, the solids entrained in the liquid are not able to enter the gap between the seal surfaces. Thus both the leakage of the liquid and wearing of the seals are reduced.

When the static seal wears, it is possible to adjust the clearance thereof while the pump is running, because it is possible to arrange the adjustment in connection with a seal cover attached to the cover of the pump housing or to the housing, which seal cover operates as a counter member of the static seal. Thereby, the adjustment can be performed more quickly than in the conventional arrangement.

The shaft is protected from the liquid to be pumped by means of a shaft sleeve arranged on the shaft and extending from the repeller hub up to the static sealing. The shaft sleeve has a radial collar that acts as the sealing counter surface of the static sealing.

If the static seal leaks, it is possible to collect the splashes to the seal cover and lead such in a controlled manner therefrom to a leakage collection system. The seal cover may also be designed such that the rotary shaft can be covered, whereby the shaft will neither be a risk in the adjustment of the seal clearance nor will it prevent from performing the adjustment, as was the case in the prior art solutions.

The seal surfaces are mutually arranged such that if, for some reason, solids are able to enter or form in the sealing gap, the rotation of the seal surface creates a centrifugal force that discharges the solids out of the sealing space whereby the risk of wearing of the sealing space, and the seal surfaces is minimized.

The rotary seal surface is arranged such that it is always aligned exactly perpendicular to the axis of the pump ensuring the optimal conditions for the operation of the static seal.

The stationary seal member is arranged in connection with the seal cover, and it is made of a flexible and wearing material such that it conforms by means of both flexing and wearing to the possible misalignment of the seal cover.

Figure 4:
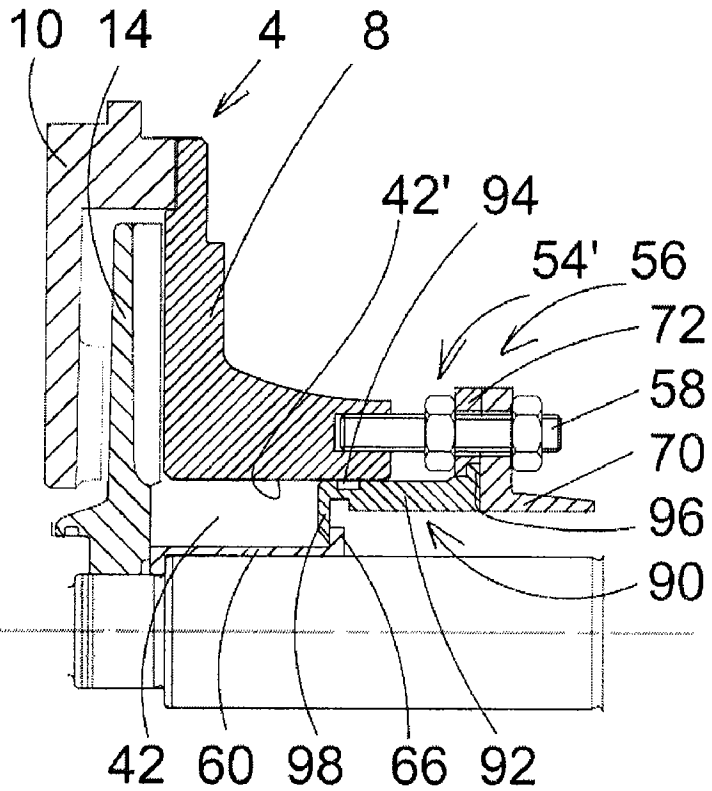
Figure 3:
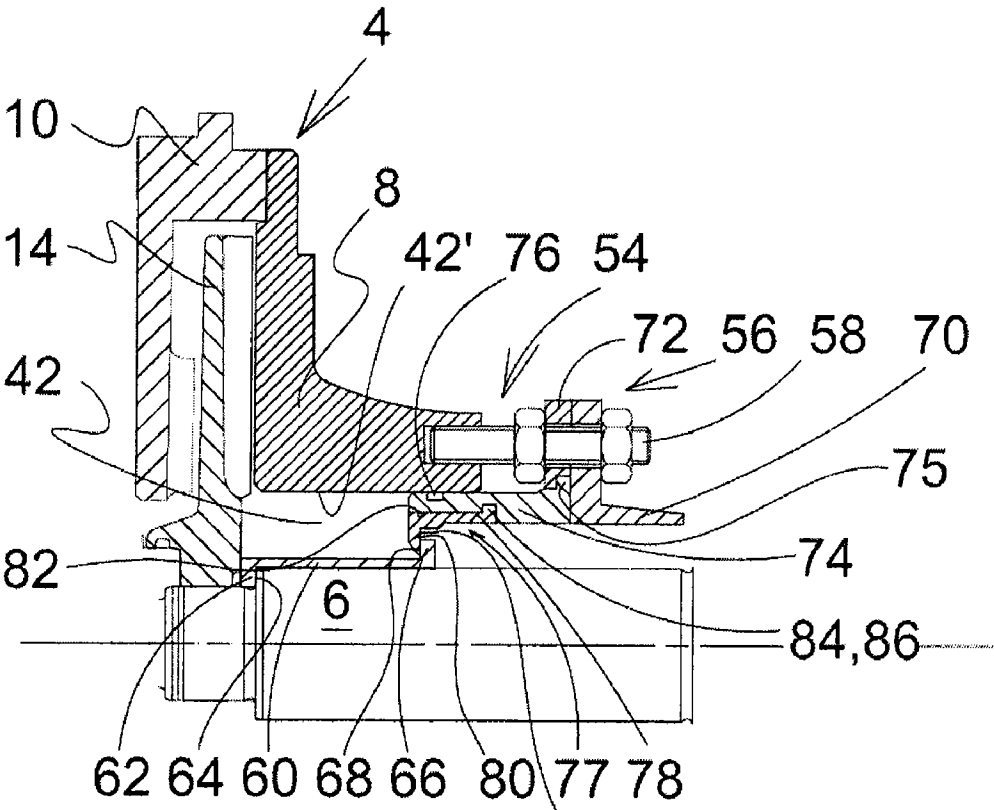

The centrifugal pump, the shaft sleeve, and the stationary seal member in accordance with the present invention are discussed more in detail below, by way of example, with reference to the accompanying drawings, in which FIG. 1 schematically illustrates a static seal in accordance with the prior art, in connection with a dynamic sealing of a centrifugal pump, FIG. 2 schematically illustrates another static seal in accordance with the prior art, in connection with a dynamic sealing of a centrifugal pump, FIG. 3 illustrates a static seal in accordance with a preferred embodiment of the present invention, and FIG. 4 illustrates a static seal in accordance with another preferred embodiment of the present invention.

FIG. 1 schematically illustrates a conventional construction of a static seal 2 used in connection with a dynamic sealing 4 of a centrifugal pump in accordance with the prior art. The impeller and the volute of the centrifugal pump are located to the left hand side of the drawing. The centrifugal pump pumps liquid entering the pump from the left along a suction duct to a pressure opening of the pump volute. The impeller is attached to the pump shaft 6, which is mounted with bearings to the right, the part being already cut away, to the pump housing 8. The pump volute is limited behind the pump impeller by the rear wall 10 of the pump. The rear wall 10 of the pump is attached to the pump housing 8 such that they leave a flat circular chamber 12 therebetween. The chamber 12 is called a dynamic sealing chamber. A circular disc 14 is attached to the pump shaft 6, and located in said annular dynamic sealing chamber 12. Together the sealing chamber 12 and the annular disc 14, called a repeller, form the dynamic sealing 4 of the pump. The rotary disc i.e. the repeller 14 attached to the shaft 6 divides the dynamic sealing chamber 12 to an impeller side cavity 16 and a pump bearing side cavity 18 in such a way that there is a flow connection between said cavities outside the outer circumference of the repeller 14. The repeller 14 is provided with vanes 20 on the side facing said bearing side cavity 18, the vanes 20 extending substantially throughout the whole radial dimension of the repeller disc, while the opposite side of the repeller 14 is even. The purpose of the repeller vanes 20 is to pump liquid in the bearing side cavity 18 outwards towards the impeller side cavity 16, which again is affected by the pressure generated by the impeller of the pump reduced by the counter pressure generated by the rear vanes of the impeller. In other words, the vanes 20 of the repeller generate a pressure affecting from cavity 18 to cavity 16 and towards the impeller of the pump, by means of which the pressure prevailing in the space behind the pump impeller is balanced.

A typically used static seal of the above described dynamic sealing of the centrifugal pump is a flexible static disc 22 arranged behind the dynamic sealing 4, as seen from the direction of the pump volute, which static disc 22 is attached by means of an annular ring 24 and bolts or headless screws 26 to the pump housing or the cover of the housing, and which, when the pump stops, is pressed against a rotary counter ring 28 of the static seal 2 arranged on the shaft 6, and prevents liquid from flowing out of the pump. In other words, the liquid entering from the direction of the pump volute (from the left in the drawing), thus, presses the seal disc 22 against the counter ring 28. The counter ring 28 is attached on the shaft 6 with one or more screws. However, the above discussed static seal structure has the disadvantage that it cannot be adjusted while the pump is running, but for the adjustment the pump has to be stopped. Another problem with the rotary counter ring 28 is its mounting on the shaft. There is always a small gap between the shaft and the opening through the counter ring whereby the ring may not always be positioned such that its seal surface is exactly perpendicular to the pump axis. If the ring is not aligned with the axis the seal surface does not rotate in a radial plane, and the flexible seal is not able to touch the entire rotary seal surface but only such a part thereof, which is closest to the flexible seal. The result is a leaking and wearing seal.

FIG. 2 illustrates another prior art seal arrangement. In the illustrated seal structure the flexible seal member 30 is redesigned by positioning it on the shaft 6, whereby it is rotary and it, among other things, prevents the shaft 6 from coming into contact with the liquid to be pumped. The stationary counter ring 32 is located behind the flexible seal means 30, as seen from the direction of the pump volute.

The flexible seal means 30 of the static seal is formed of a tubular cylinder having an even diameter at the part 34 facing the pump impeller, followed by a constricted part 36, which has a smaller diameter than the part 34, the purpose of which part 36 is to ensure the flexibility of the seal, and further followed by a lip 38 having a larger diameter and facing the stationary counter ring 32. The axial dimension of the lip 38 diminishes towards the radially outer circumference of the lip 38. A seal surface 40 of the flexible seal means 30, which is by default generally perpendicular to the axis of the shaft 6 and which is pressed against the end surface of the counter ring 32, may be either straight or at least partially inclined while the tip of the lip 38 is closer to the surface of the counter ring. When the seal surface 40 is inclined by a suitable dimensioning, the tip of the lip tends to turn outwards, due to the centrifugal force, when the pump is started, and, at the same time, slightly away from the counter ring 32.

However, it has been learned that especially when the sealing has been in use for some time the flexibility of the seal lip 38 decreases, and the seal starts to leak. The reason for the leak is that while the rotational speed of the pump decreases, the lip 38 is not able to return quickly enough into communication with the opposing seal surface, but the liquid layer advancing spirally along the outer circumference of the shaft space 42 reaches the sealing gap first and the seal leaks until the liquid pressure acting on the lip surface opposed to the seal surface is able to press the seal surfaces together.

FIG. 2 shows also the counter ring 32, which is a part of an annular seal cover 44 attached to the cover of the pump housing or to the housing 8, in more detail. The counter ring 32 acts as the counterpart of the flexible seal means 30 of the static seal. The seal cover 44 is attached to the pump housing or to the cover of the housing by means of a flange 46 extending from an otherwise substantially tubular seal cover 44. The flange 46 is provided with openings required for attachment bolts or headless screws 48, by means of which the seal cover is attached to the pump housing 8 or the cover of the housing. There are several, preferably three, attachment points, for the seal cover 44 acting as a second stationary part of the static seal. Thereby, it is possible to adjust the static seal by means of the headless screws 48 and the nuts 50 driven to them, whereby, when the static seal wears, the clearance thereof can be adjusted while the pump is running. Thereby, the adjustment can be performed more easily and quickly than with the conventional solution. However, due to the way the sealing clearance has to be adjusted, the above-discussed structure has its own disadvantage. Since it is, in practice, impossible to move the seal cover 44 axially in either direction such that the seal surface remains in a direction exactly perpendicular to the axis of the pump, it is obvious that the seal surface is usually somewhat misaligned from its optimal direction. Now that the rotary seal surface 40 tries to follow the non-radially arranged surface it can be expected that the rotary surface 40 starts wearing. And, even if no wear occurs, it is probable that when the rotational speed of the pump is decelerating the seal surface rotating in a non-radial plane keeps the sealing gap open such that liquid entering the shaft space is able to flow out until the rotation of the pump stops totally, and the liquid pressure is able to press the seal surfaces together.

According to FIG. 2, it is possible to collect the leakage flow of the static seal to a seal cover 44 operating as a counterpart of the flexible seal means 30 and, further, remove therefrom in a controlled manner to a collection system 52. The seal cover 44 may be extended towards the pump bearing, as is tentatively disclosed in the drawing, so that the rotary shaft 6 may be covered with the seal cover, whereby there is no risk of touching the rotating shaft when adjusting the clearance of the static seal, nor does it prevent the adjustment of the clearance, as was the case in the prior art solutions.

In FIG. 3, a static seal 54 in accordance with a preferred embodiment of the present invention has been illustrated. The dynamic sealing 4 shown at the left hand side of the drawing is both structurally and functionally similar to the one discussed in connection with prior art FIGS. 1 and 2. The static seal 54 of the present invention resembles to the one of FIG. 2 in such a sense that the adjustment of the static seal is accomplished in a similar manner, i.e. the seal cover 56 is made movable in axial direction by means of one or more adjustment means, for example by means of several bolts or headless screws 58. However, the actual sealing portion of the static seal 54 is built in a different manner. A basic feature of the invention is the rotary seal member that is arranged in connection with the shaft sleeve 60 protecting the shaft 6 from getting into contact with the liquid to be pumped. The shaft sleeve 60 is provided, in this embodiment of the invention, at its end facing the repeller 14 with a radially inwardly extending ring-shaped part 62, that sits against a shoulder 64 on the pump shaft 6 such that when assembling the pump the shaft sleeve 60 is first inserted on the shaft 6 the ring 62 facing the shoulder 64. Next the repeller 14 is mounted on the shaft 6 and then the rest of the pump components. Finally when the impeller and the repeller 14 are fastened on the shaft 6 by means of a nut arranged at the left end of the shaft 6, the ring 62 of the shaft sleeve 60 sits tightly between the shoulder 64 on the shaft 6 and the hub of the repeller 14. The opposite end of the shaft sleeve 60 i.e. the sleeve end farther away from the repeller 14 is provided with a radially outwardly extending collar 66 having two surfaces, one facing the bearings and the drive end of the shaft, and another 68 facing the repeller 14. This repeller side surface functions as the rotary static seal surface 68. The shaft sleeve 60 is preferably made of metal, though also the use of ceramic and composite materials should be taken into account. The side surface 68 of the collar 66 may directly act as the seal surface, but the side surface may as well be provided with an appropriate coating, or on the side surface there may be arranged a separate ring of appropriate material. The shaft sleeve 60, its coating or the separate ring is preferably made of metal, though also the use of ceramic and composite materials should be taken into account.

The seal cover 56 is, in the embodiment of FIG. 3, formed of three components: a preferably tubular cover 70 for the shaft 6, an annular disc 72, and a tubular part 74 extending inside the static seal chamber 42. Already at this stage it should be understood that for the working of the invention the existence of the shaft cover 70 is not necessary. Also the presence of the annular disc is not necessary but the seal cover 56 may only comprise the tubular part 74, which is provided with means for fastening the seal cover to the pump housing 8, which means have now (in FIG. 3) been included in the annular disc 72. In other words, the tubular part 74, and the annular disc 72 may be of a unitary construction, if desired, and also the shaft cover 70 may belong to the same construction. The fastening means arranged in the annular disc 72 are preferably openings for the fastening bolts or screws 58. The tubular part 74 extending axially inside the shaft space i.e. inside the static sealing chamber 42 has a flange 75 for attaching the part 74 between the annular disc 72, and the shaft cover 70. The tubular part is also provided with an annular groove 76 for, for example, an O-ring seal by means of which the tubular part 74 is sealed in relation to the sealing chamber outer surface 42'. At its end away from the fastening means the tubular part 74 is provided with an internal axially extending hollow cavity into which an, at least partially flexible, seal means 77 is arranged. In the embodiment shown in FIG. 3 the seal means 77 is formed of a substantially tubular body part 78 extending along the wall of the cavity, and a seal lip 80 extending radially inwardly from the body part 78. The body part 78 of the seal means 77 is sealed with respect to the tubular seal cover part 74 by means of, for example, an O-ring (now shown). The groove 82 for the O-ring may be arranged either in the seal means 77 (as shown in FIG. 3) or in the tubular seal cover part 74. In accordance with a preferred embodiment of the invention the seal lip 80 is arranged to the end of the body part 78 facing the repeller 14 i.e. away from the fastening means as shown in FIG. 3. However, it is possible, if such is desired to arrange the seal lip wherever along the entire length of the seal means 77. The seal lip 80 has an inner edge towards which the surfaces of the lip 80 converge. Preferably, the converging is arranged such that the seal lip surface 82 facing the seal cover 56 and the fastening means and functioning as the stationary static seal surface 82 remains substantially radial whereas the opposite surface facing the repeller 14 is the converging one. The seal means 77 is fastened, in the embodiment shown in FIG. 3, to the tubular seal cover part 74 by means of a snap fitting, i.e. the end of the seal means 77 facing the fastening means is provided with an enlarged portion 84 for which the tubular seal cover part 74 is provided with a recess 86. When the tubular part 74 is made of metal, and the seal means 77 of plastics (for instance TEFLON), or rubber or some other suitable flexible material, the seal means 77 may be pushed inside the tubular seal cover part 74 whereby the enlarged portion 84 compresses sufficiently until it is released in the recess 86. Naturally also other types of fastening may be used.

In addition to what has been discussed above or shown in FIG. 3, the seal means may be formed of a mere lip fastened to the end of the tubular seal cover part by means of a washer and a few screws, for instance.

FIG. 4 illustrates another preferred embodiment of the present invention by discussing a somewhat simplified static seal structure compared to the one shown in FIG. 3. In this embodiment of the invention the rotary seal part 60 is the same as in the embodiment of FIG. 3, whereas the tubular seal cover part 74 and the seal means 76 of FIG. 3 have been combined into one seal part 90. The seal part 90 is formed of a tubular body 92, which is arranged to be axially movable along the wall 42' of the static sealing chamber 42, and sealed with respect thereto by means of, for example, an O-ring seal (now shown) provided in the groove 94. The seal part 90 is provided with means 96 for attaching the seal part 90 to the fastening means by means of which the seal cover 56 is fastened to the pump housing 8 or the housing cover. Here, as also in the embodiment of FIG. 3, the attaching means of the seal part 90 is a radially outwardly extending flange 96, which is positioned between the annular disc 72 and the shaft cover 70. FIG. 4 shows, how the seal lip 98, which is basically similar to the one discussed in connection with FIG. 3, is arranged at the end of the seal part 90 away from the attaching means 96. However, the seal lip 98 may be arranged to some other position along the length of the seal part 90. The material for the seal part is preferably plastics, like, for instance Teflon.

As can be seen from the above description, it has been possible to develop a static seal which is more versatile than the previous static seal arrangements, said arrangement enabling, for example, the adjustment of the seal clearance while the pump is running. While the invention has been herein described by way of examples in connection with what are at present considered to be the preferred embodiments, it is to be understood that the invention is not limited to the disclosed embodiments, but is intended to cover various combinations and/or modifications of its features and other applications within the scope of the invention as defined in the appended claims. Thus it is also clear that individual features explained in connection with one embodiment may be used together with some other feature/features of some other embodiment as long as such is technically feasible.

The invention claimed is:

1. A centrifugal pump, comprising a pump housing, a shaft, an impeller attached on the shaft, a dynamic sealing having a sealing chamber and a repeller mounted on the shaft, and a static seal arranged in a shaft space behind the dynamic sealing as seen from the direction of the impeller, said static seal comprising an axially adjustable seal cover including a stationary seal member with a tubular body part; and with the static seal further comprising a rotary seal member arranged on the shaft, characterized in that the stationary seal member is a flexible seal member provided as part of the seal cover, in that said stationary seal member comprises a seal lip extending radially inwardly from the body part, and in that the rotary seal member is arranged in connection with a shaft sleeve arranged on the shaft.

2. The centrifugal pump as recited in claim 1, characterized in that the shaft sleeve is fastened between a shoulder on the shaft and the repeller.

3. The centrifugal pump as recited in claim 1, characterized in that the shaft sleeve is provided with a radially outwardly extending collar having a rotary seal surface.

4. The centrifugal pump as recited in claim 1, characterized in that the seal cover comprises a seal part.

5. The centrifugal pump as recited in claim 1, characterized in that said seal cover comprises an annular ring in connection with which a tubular part carrying a seal part is arranged.

6. The centrifugal pump as recited in claim 1, characterized in that said sleeve, the coating of the seal surface on the collar or the separate ring is made of metal, ceramic or composite material.

7. The centrifugal pump as recited in claim 1, characterized in that the seal cover comprises a tubular body portion in connection with which a seal part is arranged.

8. The centrifugal pump as recited in claim 7, characterized in that said seal part comprises at least a radially inwardly extending seal lip, which is arranged in operative communication with said rotary seal surface arranged on said collar of said shaft sleeve.

9. The centrifugal pump as recited in claim 8, characterized in that said seal cover comprises an annular ring in connection with which a seal part is arranged.

10. The centrifugal pump as recited in claim 8, characterized in that said seal part is formed of a tubular body part, and a radially inwardly extending seal lip.

11. The centrifugal pump as recited in claim 8, characterized in that said seal part further comprises a tubular body part to which said seal lip is arranged.

12. The centrifugal pump as recited in claim 11, characterized in that the seal cover is attached to the pump housing and/or to a cover of the housing by means of adjusting means.

13. The centrifugal pump as recited in claim 12, characterized in that said adjusting means comprise a separate annular ring or a ring arranged in combination with one of said seal part and said tubular part, and the attachment bolts or headless screws.

14. The centrifugal pump as recited in claim 1, characterized in that said sleeve is provided with a radially inwardly extending ring at its end opposite the collar.

15. The centrifugal pump as recited in claim 14, characterized in that said static seal surface is arranged as an appropriate coating or a separate ring shaped member on said collar.

* * * * *